US006937193B2

(12) United States Patent
Hendler et al.

(10) Patent No.: US 6,937,193 B2
(45) Date of Patent: Aug. 30, 2005

(54) WIDEBAND PRINTED MONOPOLE ANTENNA

(75) Inventors: Jason M. Hendler, Indian Harbour Beach, FL (US); Frank M. Caimi, Vero Beach, FL (US); Mark Montgomery, Melbourne Beach, FL (US); Li Chen, Melbourne, FL (US); John Charles Farrar, Indialantic, FL (US)

(73) Assignee: SkyCross, Inc., Melbourne, FL (US)

( * ) Notice: Subject to any disclaimer, the term of this patent is extended or adjusted under 35 U.S.C. 154(b) by 149 days.

(21) Appl. No.: 10/453,841

(22) Filed: Jun. 3, 2003

(65) Prior Publication Data

US 2004/0125020 A1 Jul. 1, 2004

Related U.S. Application Data

(60) Provisional application No. 60/385,702, filed on Jun. 4, 2002.

(51) Int. Cl.[7] ..... H01Q 1/38
(52) U.S. Cl. ..... 343/700 MS; 343/846
(58) Field of Search ..... 343/700 MS, 846, 343/848, 850, 853

(56) References Cited

U.S. PATENT DOCUMENTS

| | | | | |
|---|---|---|---|---|
| 4,063,246 | A * | 12/1977 | Greiser | 343/700 MS |
| 4,847,625 | A | 7/1989 | Dietrich et al. | 343/700 MS |
| 5,293,176 | A | 3/1994 | Elliot | 343/797 |
| 5,406,233 | A | 4/1995 | Shih et al. | 333/161 |
| 5,497,164 | A | 3/1996 | Croq | 343/700 MS |
| 5,680,144 | A | 10/1997 | Sanad | 343/700 MS |
| 5,828,340 | A | 10/1998 | Johnson | 343/700 MS |
| 5,923,296 | A | 7/1999 | Sanzgiri et al. | 343/700 MS |
| 5,926,137 | A | 7/1999 | Nealy | 343/700 MS |
| 6,023,244 | A | 2/2000 | Snygg et al. | 343/700 MS |
| 6,057,802 | A | 5/2000 | Nealy et al. | 343/700 MS |
| 6,232,923 | B1 | 5/2001 | Guinn et al. | 343/700 MS |
| 6,252,550 | B1 | 6/2001 | Vernon | 343/700 MS |
| 6,300,906 | B1 | 10/2001 | Rawnick et al. | 343/700 MS |
| 6,320,544 | B1 | 11/2001 | Korisch et al. | 343/700 MS |
| 6,339,404 | B1 | 1/2002 | Johnson et al. | 343/794 |
| 6,392,599 | B1 | 5/2002 | Ganeshmoorthy et al. | 343/700 MS |
| 6,549,170 | B1 | 4/2003 | Kuo et al. | 343/702 |

OTHER PUBLICATIONS

Burberry, R. A.; "VHF and UHF Antennas"; IEE Electromagnetic Waves Series 35; 1992; pp. 24–58.

* cited by examiner

*Primary Examiner*—Hoang V. Nguyen
(74) *Attorney, Agent, or Firm*—John L. DeAngelis, Jr.; Beusse Brownlee Wolter Mora & Maire, P.A.

(57) ABSTRACT

An antenna comprising two monopole elements and a ground plane disposed on a dielectric substrate. The elements are spaced apart to provide spatial diversity and have a shape to provide operation in multiple frequency bands and/or over a wide bandwidth of frequencies.

57 Claims, 4 Drawing Sheets

WIDEBAND PRINTED MONOPOLE ANTENNA

This application claims the benefit of the provisional application filed on Jun. 4, 2002, assigned application Ser. No. 60/385,702 and entitled, Wideband Printed Monopole Antenna.

FIELD OF THE INVENTION

The present invention relates generally to antennas for transmitting and receiving radio frequency signals, and more specifically to such antennas operating over a wide bandwidth of frequencies or over multiple frequency bands.

BACKGROUND OF THE INVENTION

It is generally known that antenna performance is dependent upon the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity, signal polarity and the radiation pattern. Generally for an operable antenna, the minimum physical antenna dimension (or the electrically effective minimum dimension) must be on the order of a quarter wavelength (or a multiple thereof) of the operating frequency, which thereby advantageously limits the energy dissipated in resistive losses and maximizes the energy transmitted. Quarter wavelength and half wavelength antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (i.e., selectable radiation patterns or selectable signal polarizations). Smaller packaging of state-of-the-art communications devices may not provide sufficient space for the conventional quarter and half wavelength antenna elements. Thus physically smaller antennas operating in the frequency bands of interest and providing the other desirable antenna operating properties (input impedance, radiation pattern, signal polarization, etc.) are especially sought after.

As is known to those skilled in the art, there is a direct relationship between physical antenna size and antenna gain, at least with respect to a single-element antenna, according to the relationship: gain=$(\beta R)^2+2\beta R$, where R is the radius of the sphere containing the antenna and $\beta$ is the propagation factor. Increased gain thus requires a physically larger antenna, while communications device manufacturers and users continue to demand physically smaller antennas. As a further constraint, to simplify the system design and strive for minimum cost, equipment designers and system operators prefer to utilize antennas capable of efficient multi-frequency and/or wide bandwidth operation, allowing the communications device to access various wireless services operating within different frequency bands from a single antenna. Finally, gain is limited by the known relationship between the antenna frequency and the effective antenna length (expressed in fractional wavelengths). That is, the antenna gain is constant for all quarter wavelength antennas of a specific geometry i.e., at that operating frequency where the effective antenna length is a quarter wavelength of the operating frequency.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

One basic antenna commonly used in many applications today is the half-wavelength dipole antenna. The radiation pattern is the familiar omnidirectional donut shape with most of the energy radiated uniformly in the azimuth direction and little radiation in the elevation direction. The typical gain is about 2.15 dBi. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz.

The quarter-wavelength monopole antenna positioned above a ground plane is derived from a half-wavelength dipole. The physical antenna length is a quarter-wavelength, but since the ground plane (ideally an infinite ground plane) produces an image antenna element the performance resembles that of a half-wavelength dipole. Thus the radiation pattern for a monopole antenna above a ground plane is similar to the half-wavelength dipole pattern, with a typical gain of approximately 2 dBi. It is known that for portable wireless radio equipment a monopole antenna mounted perpendicular to a conducting finite ground plane provides an antenna having good radiation characteristics, a driving point impedance that can be matched to the radio circuitry and relatively simple construction. As compared to a common dipole, the monopole is also smaller in size.

However, as mentioned above, reducing antenna size reduces the operational bandwidth due to the functional relationship between input impedance and frequency. The bandwidth reduction is caused by combination of lower radiation resistance due to the smaller antenna size and a larger amount of stored energy, creating a high Q antenna bandwidth and lower radiation bandwidth. One technique for overcoming the bandwidth limitation, especially applicable to a monopole antenna, surrounds the radiating element with a sleeve. The sleeve extends the ground plane, forming a virtual feed point along the radiating element, thereby extending the antenna bandwidth.

The common free space (i.e., not above ground plane) loop antenna (with a diameter of approximately one-third the wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics. However, conventional loop antennas are too large for handset applications and do not provide multi-band operation. As the loop length increases (i.e., approaching one free-space wavelength), the maximum of the field pattern shifts from the plane of the loop to the axis of the loop. Placing the loop antenna above a ground plane generally increases its directivity.

Printed or microstrip antennas are constructed using the principles of printed circuit board techniques, where a top metallization layer overlying a dielectric substrate serves as the radiating element. These antennas are popular because of their low profile, the ease with which they can be fabricated and a relatively low fabrication cost. One such antenna is the patch antenna, comprising in stacked relation, a ground plane, a dielectric substrate, and a radiating element overlying the top substrate surface. The patch antenna provides directional hemispherical coverage with a gain of approximately 3 dBi. Although small compared to a quarter or half wavelength antenna, the patch antenna has relatively poor radiation efficiency, i.e., the resistive return losses are relatively high within its operational bandwidth. Also, disadvantageously, the patch antenna exhibits a relatively narrow bandwidth. Multiple patch antennas can be stacked in parallel planes or spaced-apart in a single plane to synthesize a desired antenna radiation pattern that may not be achievable with a single patch antenna.

Given the advantageous performance of quarter and half wavelength antennas, many wireless devices employ such antennas. Many wireless devices use a monopole antenna, where the antenna length is on the order of a quarter wavelength of the radiating frequency and the antenna is disposed over a ground plane. These dimensions allow the antenna to be easily excited and operated at or near a resonant frequency, while limiting the energy dissipated in resistive losses and maximizing the transmitted energy. But, as the operational frequency increases/decreases, the operational wavelength correspondingly decreases/increases. Since the monopole antenna over a ground plane should ideally present an electrical length that is a quarter wavelength at the operational frequency, when the operational frequency changes the antenna is no longer operating at a resonant condition and antenna performance deteriorates.

As can be inferred from the above discussion of various antenna designs, each exhibits know advantages and disadvantages. The dipole antenna has a reasonably wide bandwidth and a relatively high antenna efficiency (or gain). The major drawback of the dipole, when considered for use in personal wireless communications devices, is its size. At an operational frequency of 900 MHz, the half-wave dipole comprises a linear radiator of about six inches in length. Clearly it is difficult to position such an antenna in the small space envelope associated with today's handheld devices. By comparison, the patch antenna or the loop antenna over a ground plane present a lower profile antenna structure than the dipole, but as discussed above, operate over a narrower bandwidth with a highly directional radiation pattern.

As discussed above, multi-band or wide bandwidth antenna operation is especially desired for use with various personal or handheld communications devices. One approach to producing an antenna having multi-band capability is to design a single structure (such as a loop antenna) and rely upon the higher-order resonant frequencies of the loop structure to obtain a radiation capability in multiple frequency bands.

Another known method for achieving multi-band performance uses two separate spaced-apart antennas with coupled inputs or feeds for signal splitting according to methods well known in the art. Each of the two antennas resonates at a predictable frequency to provide operation in at least two frequency bands. Certain wireless devises thus employ two or more relatively narrowband antennas to cover a frequency range of interest at the expense of requiring additional space within or proximate the wireless device.

In high signal scattering environments in which wireless devices typically operate, such as office buildings and urban environments, signal fading is a common problem. The signal is reflected from the atmosphere and structures along the path from the transmitter to the receiver, creating multiple received signals, each traversing a different path length. Thus at the receiver, the signals are typically not in phase synchronism, and when coherently combined at the antenna, signal cancellation (i.e., destructive interference) causes a signal fading effect. Such signal fading can be overcome by using two or more antennas to achieve spatial antenna diversity. If the antennas are designed for maximum isolation, then the signals received at each antenna can be considered statistically independent and the likelihood of signal fading is reduced. If spatial and frequency diversity are desired, two sets of antennas are required for each frequency band, with one set providing diversity reception in each band. Clearly, such schemes consume an inordinate amount of space. Further, the degree of diversity provided is functionally related to the antenna spacing. Thus greater diversity requires greater spacing between the antennas and a physically larger antenna system.

Broadband monopole antennas are known in the art and generally comprise solids of rotation oriented with the axis of rotation perpendicular to the ground plane. Examples of such monopole antennas include: a discone antenna, a cylinder over a ground plane, a monopole antenna on a large sleeve (as described above), a top-loaded monopole antenna, a non-circular monopole antenna, an ellipsoidal monopole antenna, and a helical antenna over a ground plane. Several such antennas are described in *VHF and UHF Antennas*, by R. A. Burberry, published by Peregrinus, 1992.

Each of the many antenna configurations discussed above has certain advantageous features, but none offer all the performance requirements desired for handset and other wireless applications, including dual or multi-band operation, high radiation efficiency, high gain, low profile and low fabrication cost. Thus notwithstanding the many known techniques for achieving the desired antenna performance, it remains difficult to realize an efficient antenna or antenna system that satisfies the multi-band/wide bandwidth operational features in a relatively small physical volume.

BRIEF SUMMARY OF THE INVENTION

An antenna system comprising a dielectric substrate having a surface with first and second spaced-apart monopole elements disposed thereon. A ground plane is also disposed on the first surface in proximate relation to the first and the second monopole elements.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
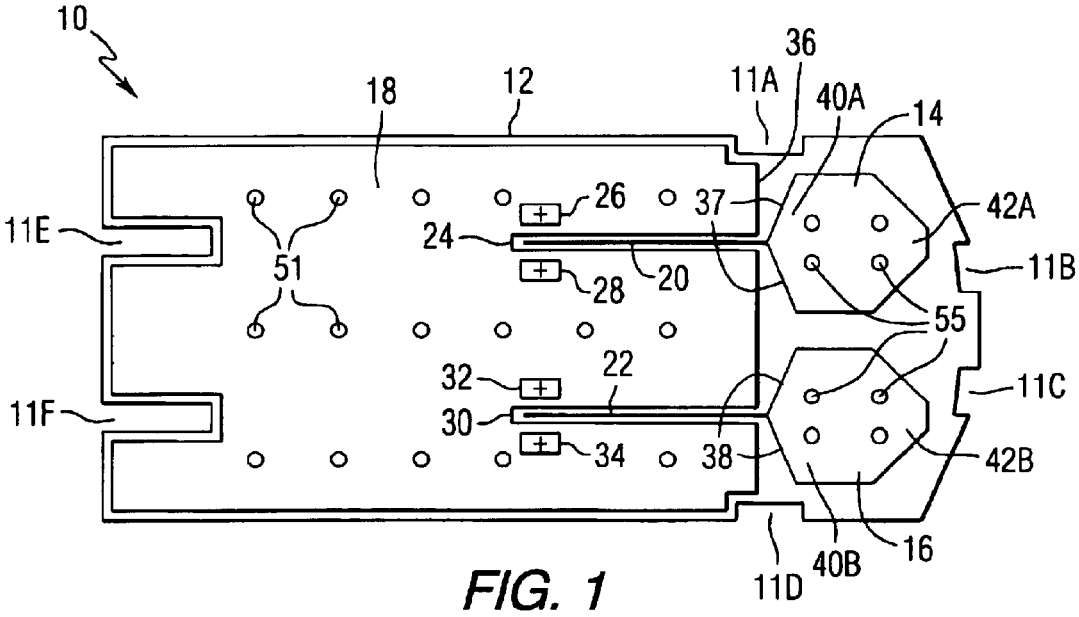
FIG. 1 is a top view of an antenna constructed according to the teachings of the present invention.

Before describing in detail the particular wideband antenna in accordance with the present invention, it should be observed that the present invention resides primarily in a novel combination of elements. Accordingly, the elements have been represented by conventional elements in the drawings, showing only those specific details that are pertinent to the present invention, so as not to obscure the disclosure with structural details that will be readily apparent to those skilled in the art having the benefit of the description herein.

The present invention presents a monopole antenna system providing switchable, wideband, spatially diverse, signal-polarization diverse operation, and is physically compact for convenient inclusion in a handheld or otherwise small wireless communications device. The antenna system can be fabricated using known printed circuit board techniques, e.g., printing of conductive material on a dielectric substrate or patterned etching of a conductive layer disposed on a dielectric substrate. These fabrication techniques are especially adaptable to high volume production, resulting in a relatively low cost antenna system product.

The increased bandwidth of an antenna system constructed according to the teachings of the present invention allows operation of a wireless device with broadband wireless technologies that offer high data rates and thus require wideband components in the transmit and receive paths. Certain wireless devices operate on multiple spectrum channels or on multiple spaced-apart frequencies. The wideband antenna system of the present invention can be advantageously used with such wireless devices. For example, wireless devices operating in accordance with the IEEE standards 802.11a, b or g (i.e., a center frequency of 5.25 GHz for the 802.11a standard and 2.45 GHz for the 802.11b standard) can advantageously use an antenna constructed according to the teachings of the present invention.

An antenna system 10 constructed according to the teachings of the present invention is illustrated in FIG. 1. Although the antenna system 10 is shown as disposed on a dielectric substrate 12 in the shape of a PCMCIA card, this shape is not a requirement for wideband operation, as the shape and form factor of the antenna system 10 may be modified as dictated by a specific application and the available space envelope. Also, slots 11A–11F about the periphery of the substrate 12 are not germane to the antenna system 10, but rather are also dictated by the form factor for the PCMCIA card.

Figure 5:
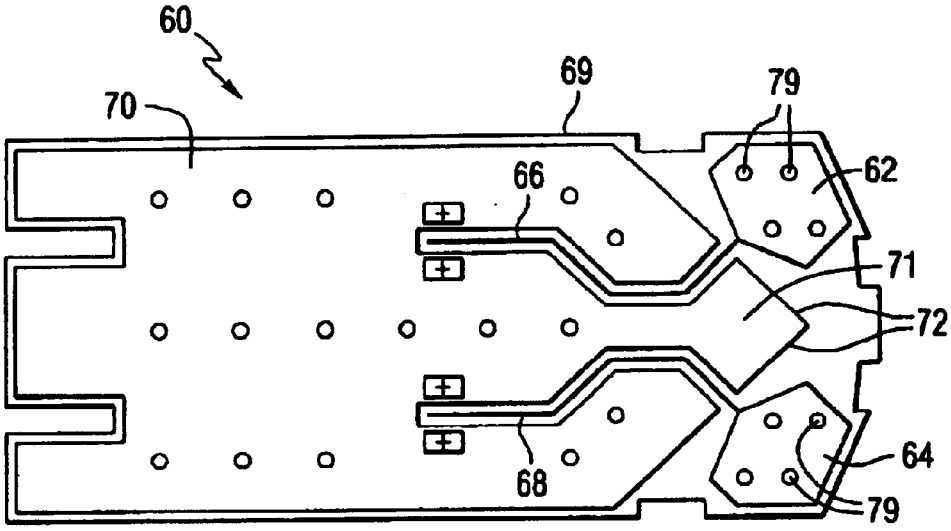
FIG. 5 is top view of an antenna constructed according to another embodiment of the present invention.

In the embodiment of FIG. 1, to be described more thoroughly below, the antenna operates in the band of frequencies between 1.7 GHz and 6 GHz with a voltage standing wave ratio of about 2:1, in both a spatial diversity configuration (FIG. 1) and in a configuration offering a combination of spatial and polarity diversity (FIG. 5).

FIG. 1 is a top view of the antenna system 10, including monopole radiating elements 14 and 16 proximate a ground plane 18, disposed on the dielectric substrate 12. The signal is provided to or derived from the radiating elements 14 and 16 over transmission lines 20 and 22, respectively. When incorporated into a wireless device, typically the center conductor of a first coaxial cable (not shown) is connected to a terminating end 24 of the transmission line 20. The ground shield of the first coaxial cable is connected to the ground pads 26 and 28, which are in turn connected to the ground plane 18. Similarly, the center conductor of a second coaxial cable (not shown) is connected to a terminating end 30 of the transmission line 22. The ground shield of the second coaxial cable is connected to the ground pads 32 and 34, which are in turn connected to the ground plane 18.

The ground plane shape illustrated in FIG. 1 is merely exemplary, as other shapes can be used depending on the available space and so long as acceptable antenna performance is obtained. Also, in other embodiments the ground plane is disposed on a surface of the dielectric substrate 12 opposite the surface on which the radiating elements 14 and 16 are disposed. In still another embodiment the ground plane is disposed in interior conductive layers of the dielectric substrate 12.

In another embodiment, electronic components operable in conjunction with the antenna system 10 are mounted on the dielectric substrate 12. One or more of these components are connected to the terminating ends 24 and 30 for supplying a signal to or receiving a signal from the radiating elements 14 and 16. In this embodiment the pads 26, 28, 32 and 34 are not required.

In one embodiment the dielectric substrate 12 comprises printed circuit board material (i.e., a dielectric substrate having conductive cladding disposed thereon), such as commonly available FR4 material having a thickness of about 0.032. Operation of the antenna system 10 is substantially insensitive to the board thickness. Polyester and polyimide materials are also suitable candidate materials for the dielectric substrate 12. In the embodiment where the dielectric substrate 12 comprises FR4, various elements of the antenna system 10 illustrated in FIG. 1 can be formed by patterning and etching the conductive (typically copper, but gold, silver, brass and aluminum are also suitable candidates for the material of the antenna system elements) cladding from the FR4 substrate. Alternatively, the elements of the antenna system 10 can be printed on the dielectric substrate 12 using known conductive ink printing techniques. In yet another embodiment the dielectric substrate 12 comprises a flexible material, allowing the antenna system 10 to be bent or curved to fit the available space envelope of the wireless device.

Figure 2A:
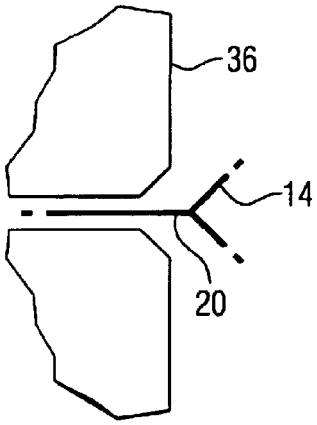
FIGS. 2A, 2B and 3A–3C illustrate alternative embodiments for certain elements of the antenna of FIG. 1.
Figure 2B:
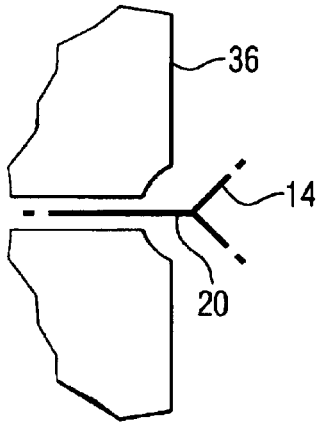

According to the embodiment of FIG. 1 the transmission lines 20 and 22 are perpendicular to an edge 36 of the ground plane 18. In other embodiments the transmission lines 20 and 22 need not be perpendicular to the edge 36. However, a symmetrical geometry (such as a "V" or parabola, etc.), causes the torroidal or omnidirectional antenna radiation pattern to be substantially symmetrical and centered on the radiating element 14 or 16. See FIGS. 2A and 2B for examples of other symmetrical geometries as applied to the transmission line 20 relative to the edge 36. Similar geometries can also be applied to the transmission line 22. Additionally, the shape of the transmission lines 20 and 22 does not significantly influence the radiation pattern nor other performance parameters of the antenna system 10.

Other embodiments where the transmission lines 20 and 22 intersect the edge 36 at other than 90° are also contemplated by the teachings of the present invention. However, the radiation pattern of such geometries may deviate from the omnidirectional pattern of a classical monopole antenna and the performance may be degraded. Thus the orientation and shape of the radiation pattern is influenced by, among other factors, the relationship of the transmission lines 20 and 22 to the edge 36.

Additionally, a distributed capacitance is formed by the proximity of the edge 36 to the edges 37 and 38 of the monopole elements 14 and 16. This capacitance, in part determined by the distance between the edge 36 and the edges 37 and 38 (including the linear edge segments that constitute the edges 37 and 38), affects the resonant frequency of the monopole elements 14 and 16. Thus adjustment of this distance and the shape of the edges 36, 37 and 38 changes the characteristics of the monopole elements 14 and 16, in particular the resonant frequency.

The monopole elements 14 and 16 are shaped to provide wideband characteristics for the antenna 10. In particular, there are first generally triangular regions 40A and 40B for providing an impedance transition from the signal lines 20 and 22, respectively to the monopole elements 14 and 16. Further, there are second generally triangular regions 42A and 42B for providing an impedance transition from the monopole elements 16 and 18 to free space. Thus the shape of the monopole elements 14 and 16 resembles a truncated kite, that is, a kite-shape with one corner removed. According to another embodiment of the present invention, the ground plane, in particular the edge 36, is shaped to effect desired antenna operational parameters. See for example, FIG. 5 to be discussed below.

The shape of the monopole elements 14 and 16 illustrated in FIG. 1 is merely exemplary, and the impedance transition regions 40A, 40B, 42A and 42B are advantageous but not required. Other polygonal shapes, structures having linear or curved edges, or structures having a combination of linear and curved edges, can also be used as the monopole elements 14 and 16. See additional exemplary shapes illustrated in FIGS. 3A–3C. Advantageously, the monopole elements 14 and 16 are constructed to present multiple interior paths for current flow, such that each such path represents a resonant frequency, allowing the element to resonant at multiple resonant frequencies and over multiple frequency bands. Additionally, since the antenna system 10 provides multiple resonant conditions, the operational bands of two resonant conditions can merge to encompass both of the resonant bands, and thereby provide broader band resonances.

Each of the monopole elements 14 and 16 produces a torroidal or omnidirectional radiation pattern, i.e., the familiar donut pattern, with the monopole elements 14 and 16 positioned at the pattern center. The polarization of the signal transmitted from the antenna system 10 is aligned with the transmission lines 20 and 22. Thus if the antenna system 10 is vertically mounted, the resulting radiation pattern is omnidirectional in the azimuth plane and the signal is vertically polarized. Generally, the radiation pattern is linearly polarized along the axis of the monopole elements 14 and 16.

In addition to the broadband performance, the monopole elements 14 and 16 are separated by a distance 46 to provide spatial diversity, ameliorating the effects of signal fading. In various embodiments, this distance can range between $5\lambda$ and $10\lambda$. In other embodiments, distances of $0.05\lambda$ to $5\lambda$ are effective to provide spatial diversity. To select the operative monopole element, a received signal quality metric is determined (by a receiving and processing apparatuses not shown) for the signal received at each of the monopole elements 14 and 16. There are several known techniques for performing this measurement and several different signal metrics that can be measured, including the signal-to-noise ratio, the bit-error rate or the ratio of bit energy to noise power spectral density. The signal quality metric is determined for each monopole element 16 and 18, and the element displaying the better signal metric is selected as the operative element, by operation of a switch (not shown). The signal metric measurement can be taken at predetermined intervals to ensure the operative monopole element 14 or 16 is the element providing the better diversity operation. The selected operative element is typically operative in both the transmit and receive modes based on the received signal metric.

Although spatial diversity (and polarization diversity to be discussed below) are desired attributes for the various antenna systems described herein, they are not required. Thus in another embodiment an antenna system constructed according to the teachings of the present invention comprises a single monopole element.

Figure 4:
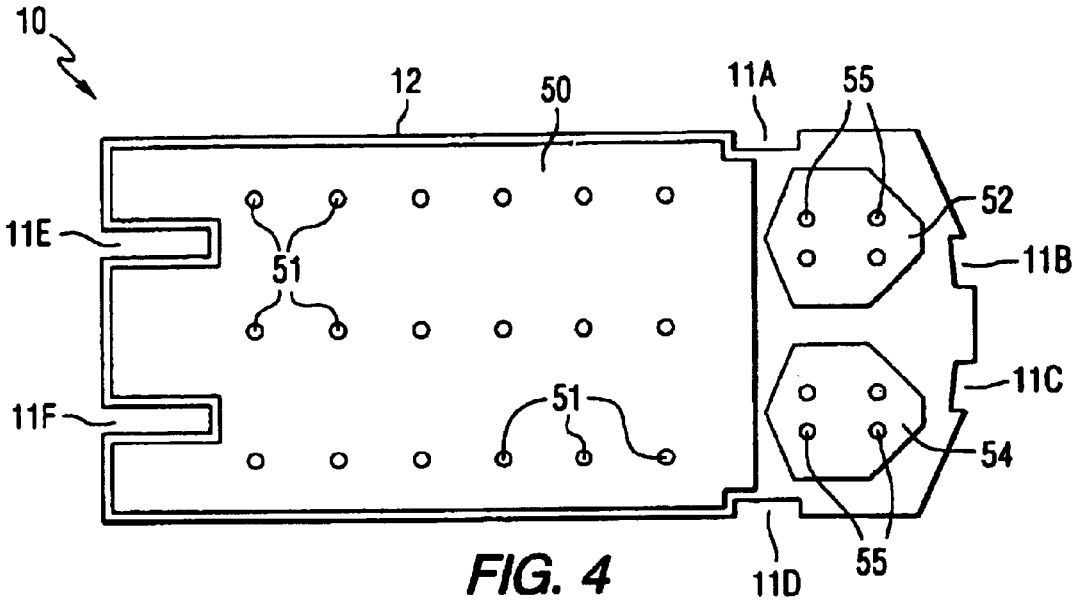
FIG. 4 is a bottom view of the antenna of FIG. 1.

FIG. 4 illustrates a bottom view of the substrate 12, comprising a ground plane 50 electrically connected to the ground plane 18 through conductive vias 51 extending through the substrate 12. Monopole elements 52 and 54 disposed on the bottom surface of the substrate 12 are essentially identical in shape to the monopole elements 14 and 16 and electrically connected thereto by conductive vias 55. The elements 52 and 54 tend to minimize the absorption of energy by the dielectric substrate 12 and thus produce a more constant radiation pattern in the azimuth direction. In another embodiment of the present invention, the monopole elements 52 and 54 are absent.

In yet another embodiment where the shape of the monopole elements 52 and 54 differs from the shape of the monopole elements 14 and 16, the asymmetry between the two sets of elements creates an unequal current distribution through the elements and an asymmetric torroidal radiation pattern, i.e., the pattern includes radiation lobes, instead of a substantially constant azimuthal radiation intensity. If the shape difference is substantial, the dominating monopole element will determine the shape of the torroidal pattern.

In one embodiment of the present invention, a region (not specifically identified in the Figures) of the dielectric substrate 12 carries electronic components associated with the operation of the wireless device and the antenna system 10. This region is formed by removing a portion of or reducing the size of the ground planes 18 and/or 50. The region is populated with electronic components, interconnecting traces, and power and ground planes. Advantageously, in such an embodiment the input signal (in the transmit mode) and the received signal (in the receive mode) are supplied to/carried from the monopole elements 14 and 16 by intermediate frequency/radio frequency components located close to the monopole elements 14 and 16 through a transmission line interconnect. The coaxial cable connection described above would not be required in this embodiment.

Other embodiments of the present invention comprise multi-layer printed circuit board material, comprising one or more internal conductive layers, which can serve as ground planes. In particular, in an embodiment where one or both of the ground planes 18 and 50 are minimized to permit the placement of electronic components on the corresponding substrate surface, use of one or more of the internal conductive layers as a ground plane provides advantageous operation of the antenna system 10. The monopole elements 14/16 and 52/54 are connected to the internal ground planes through conductive vias as is well known in the art.

FIG. 5 illustrates another embodiment of the present invention, with an antenna system 60 providing polarization and, spatial diversity. The antenna 60 comprises two monopole-radiating elements 62 and 64 each connected to a respective transmission line 66 and 68 disposed on a dielectric substrate 69. The ground plane 70 has the same general characteristics as the ground plane 18 above, but can be shaped slightly differently, including a triangular-shaped end region 71. Although non-linear transmission lines 66 and 68 are illustrated, such is not required for the present invention, as the shape of the transmission lines 66 and 68 does not substantially affect performance of the antenna system 60.

Note in the exemplary illustration of FIG. 5, the transmission lines 66 and 68 are illustrated as perpendicular to edges 72 of the ground plane 70, which is not a required feature of the present invention, as discussed above. In this embodiment the transmission lines 66 and 68 are also oriented perpendicular to each other as they cross the edge 72 to provide the aforementioned polarization diversity. The axis of the omnidirectional radiation pattern of one monopole element is perpendicular to the omnidirectional axis of the other monopole element. Thus simultaneous operation of both monopole elements 62 and 64 provides two substantially perpendicular omnidirectional radiation patterns. As discussed in conjunction with FIG. 1 above, a signal metric measuring apparatus selects one of the monopole elements 62 and 64 to offer the better received signal based not only on the spatial diversity provided by the monopole elements 66 and 68, but also on the signal polarization diversity.

Figure 3A:
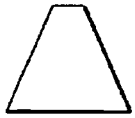
Figure 3B:
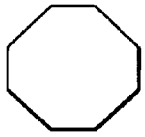
Figure 3C:
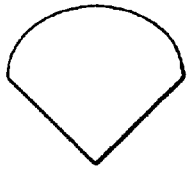
Figure 6:
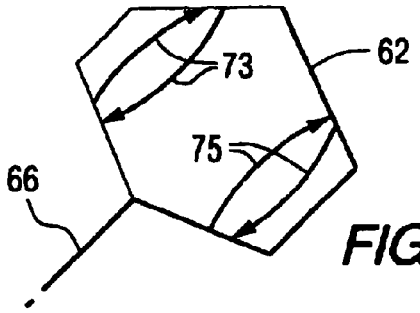
FIG. 6 illustrates multiple resonant current paths for the antenna of FIG. 4.

The monopole radiating elements 62 and 64 are constructed from a plurality of linear line segments to create multiple interior paths for current flow at a specific resonant frequency. Two such paths 73 and 75 are depicted in FIG. 6. As can be appreciated by those skilled in the art, other element shapes can be used in place of the shapes of the monopole radiating elements 62/64 and 14/16 to provide element resonance characteristics over a wider bandwidth or at two or more resonant frequencies by providing current flow paths that are an integer multiple of the resonant wavelength. Certain additional exemplary shapes are illustrated in FIGS. 3A–3C.

Figure 7:
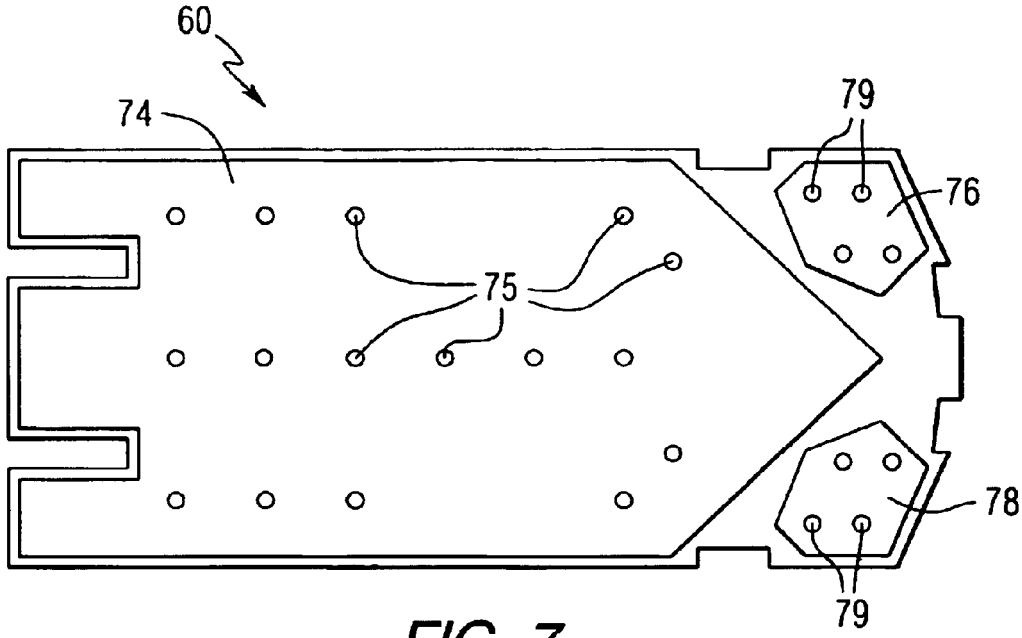
FIG. 7 is a bottom view of the antenna of FIG. 4.

FIG. 7 illustrates a bottom view of the dielectric substrate 69, including a ground plane 74 electrically connected by way of vias 75 to the ground plane 70, and monopole elements 76 and 78 electrically connected to the monopole elements 62 and 64, respectively by vias 79.

In the embodiments illustrated above, the antenna systems are illustrated as disposed on a printed circuit board compliant with the PCMCIA. This is merely exemplary, as the teachings of the present invention can be adapted to any size or composition board. Also, the monopole element shapes are modifiable to fit within the available board space, recognizing that broadband performance is desired. Additionally, the location and the orientation of the feed points, e.g., the terminating ends 24 and 30 (i.e., the point where the transmission lines are connected to the source element and/or the receiving element) are selectable based on the interface between the antenna systems of the present invention and the electronic components of the wireless device.

Figure 8:
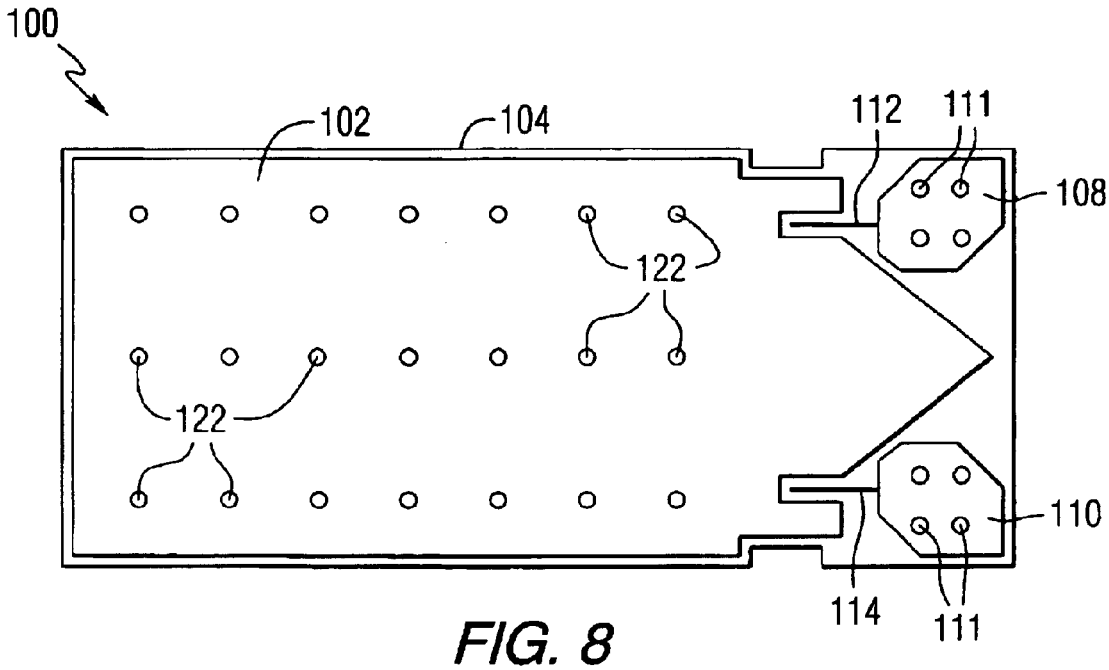
FIGS. 8 and 9 illustrate another embodiment of an antenna constructed according to the teachings of the present invention.
Figure 9:
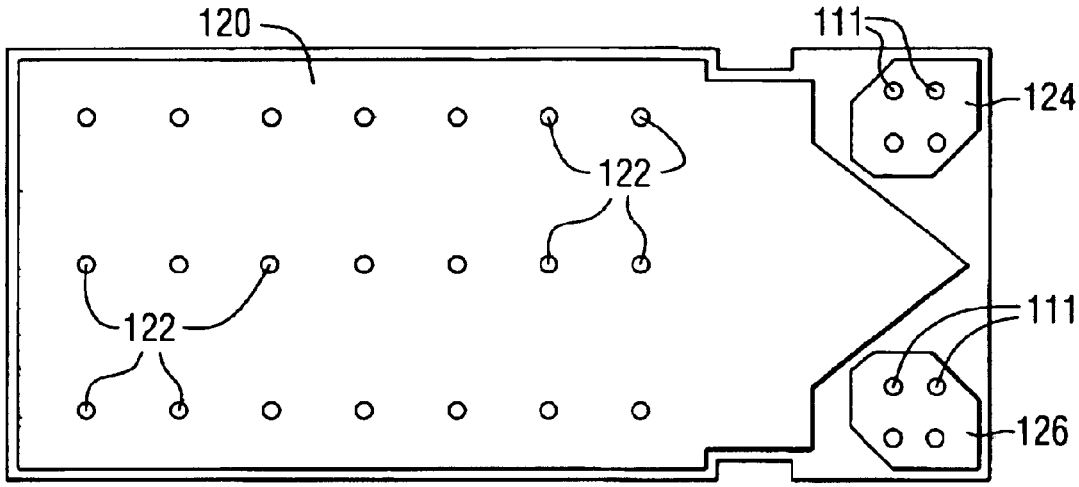

Another embodiment of the present invention is illustrated in FIGS. 8 and 9. As shown in FIG. 8, an antenna system 100 comprises a ground plane 102 disposed on a dielectric substrate 104. Monopole elements 108 and 110 are also disposed on the substrate 104 and formed according to known patterning and etching or conductive ink printing techniques. Transmission lines 112 and 114 extend from the monopole elements 108 and 110 for connection to a conductive lead for connection to off-antenna elements, such as signal transmitting and receiving devices. Alternatively, if the area of the ground plane 102 is reduced, electronic circuit elements can be disposed on the substrate 104, interconnected by conductive traces thereon and connected to the transmission lines 112 and 114 to form circuits operative in conjunction with the monopole elements 108 and 110. The various adaptations and embodiments described above are also applicable to the antenna system 100.

FIG. 9 illustrates a bottom surface of the antenna 100, comprising a ground plane 120 connected to the ground plane 102 through conductive vias 122. Monopole elements 124 and 126 are disposed below the monopole elements 108 and 110 disposed on the upper surface and connected thereto by conductive vias 111.

Figure 10:
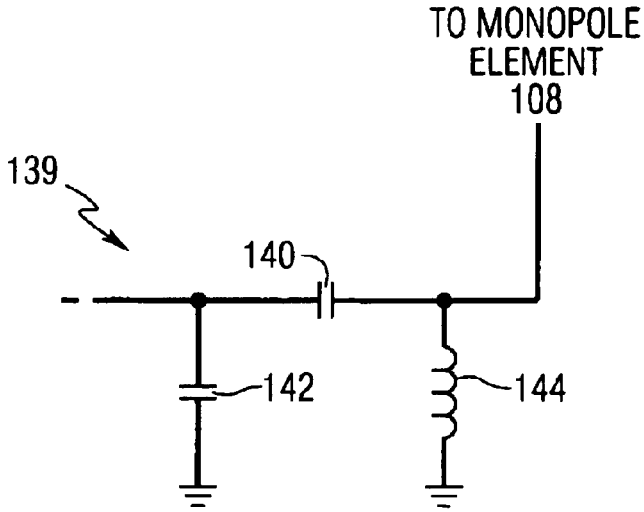
FIG. 10 depicts a compensation network for use with an antenna constructed according to the teachings of the present invention.

FIG. 10 illustrates a matching network 139 for use with the monopole element 108, comprising a series capacitor 140, a grounded capacitor 142 and a parallel-grounded inductor 144. The matching network is inserted between the monopole element 108 and the transmission line 112. A similar network is inserted between the monopole element 110 and the transmission line 114. An embodiment including the network 139 modifies the characteristics of the antenna 100 by deepening the response to certain resonant frequencies. Thus, the network 139 can advantageously optimize performance at one or more selected resonant frequencies. Use of the network 139 is not required for operation of the antenna 100.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An antenna comprising:

a dielectric substrate having a first surface and a second surface spaced-apart from and substantially parallel to the first surface;

a first monopole element disposed on the first surface, wherein the first monopole element comprises a conductive region bounded by at least three sides for exhibiting broad band resonance characteristics;

a first ground plane disposed on the first surface proximate the first monopole element;

a second ground plane disposed on the second surface; and a plurality of conductive vias passing through the dielectric substrate for interconnecting the first and the second ground planes.

2. The antenna of claim 1 wherein the first ground plane is disposed on the first surface and spaced apart from the first monopole element.

3. The antenna of claim 1 wherein the dielectric substrate comprises a second surface spaced-apart from and substantially parallel to the first surface, the antenna further comprising a second monopole element disposed on the second surface and a plurality of conductive vias passing through the dielectric substrate for interconnecting the first and the second monopole elements.

4. The antenna of claim 3 wherein the first and the second monopole elements are substantially similar in shape and are disposed in a parallel aligned relationship.

5. The antenna of claim 4 wherein a shape of the first monopole element is selected from among a quadrilaterally-shaped region and a polygonally-shaped region.

6. The antenna of claim 1 wherein the first monopole element comprises a shaped region to provide multiple current flow paths for producing broad band resonance characteristics.

7. The antenna of claim 1 further comprising a transmission line connected to the first monopole element for providing a signal to the first monopole element when the antenna is operative in a transmitting mode and for accepting a signal from the first monopole element when the antenna is operative in a receiving mode.

8. The antenna of claim 7 wherein the transmission line and the first ground plane are disposed on the first surface, and wherein the transmission line is proximate the first ground plane.

9. The antenna of claim 1 wherein the first monopole element comprises a region bounded by a plurality of linear and curved segments.

10. The antenna of claim 1 wherein the first ground plane comprises an edge proximate the first monopole element, and wherein the first monopole element is spaced apart from the edge to control a distributed capacitance formed between the first monopole element and the first ground plane.

11. The antenna of claim 1 wherein the dielectric substrate is formed from a flexible material.

12. The antenna of claim 1 wherein a radiation pattern of the first monopole element is omnidirectional.

13. The antenna of claim 1 wherein a signal polarization of the first monopole element is linear.

14. The antenna of claim 1 further comprising a transmission line connected to the first monopole element along a first boundary edge of the first monopole element, wherein the first boundary edge is shaped to provide an impedance match between the transmission line and the first monopole element.

15. The antenna of claim 14 wherein the first monopole element further comprises a second boundary edge spaced in a direction away from the first boundary edge, wherein the second boundary edge is shaped to provide an impedance match between the first monopole element and air.

16. The antenna of claim 1 wherein the first ground plane is disposed on the first surface and spaced-apart from the first monopole element, the antenna further comprising a transmission line disposed on the first surface and connected to the first monopole element, wherein the transmission line is disposed proximate the first ground plane, and wherein the first ground plane comprises an edge proximate the first monopole element, and wherein the transmission line extends beyond the edge, and wherein an angle formed between the edge and the transmission line is selected to achieve a desired antenna radiation pattern.

17. The antenna of claim 16 wherein the angle is about 90°.

18. The antenna of claim 16 wherein a shape of the edge is symmetric in the region where the transmission line extends beyond the edge.

19. The antenna of claim 1 wherein the first ground plane is disposed on the first surface and spaced-apart from the first monopole element, the first ground plane comprising an edge proximate the first monopole element, and wherein a shape of the edge is selected to provide desired antenna operational parameters.

20. The antenna of claim 1 wherein the dielectric substrate comprises an interior conductive layer substantially parallel to the first surface, and wherein the ground plane is formed from the interior conductive layer.

21. An antenna system comprising:

a dielectric substrate having a first surface;

first and second spaced-apart monopole elements disposed on the first surface;

a first signal feed connected to the first monopole element and a second signal feed connected to the second monopole element; and a first ground plane disposed proximate the first and the second monopole elements.

22. The antenna system of claim 21 wherein the first ground plane is disposed on the first surface, and wherein the dielectric substrate further comprises a second surface spaced-apart from and substantially parallel to the first surface, the antenna system further comprising a second ground plane on the second surface and a plurality of conductive vias passing through the dielectric substrate for interconnecting the first and the second ground planes.

23. The antenna system of claim 21 wherein the dielectric substrate comprises a second surface spaced-apart from and substantially parallel to the first surface, the antenna system further comprising third and fourth monopole elements disposed on the second surface and a first plurality of conductive vias passing through the dielectric substrate for interconnecting the first and the third monopole elements and a second plurality of conductive vias passing through the dielectric substrate for interconnecting the second and the fourth monopole elements.

24. The antenna of claim 23 wherein the first and the third monopole elements and the second and the fourth monopole elements are substantially similar in shape and are disposed in a parallel aligned relation.

25. The antenna of claim 21 wherein the first and the second monopole elements each comprise a shaped conductive region to provide multiple current flow paths for creating broad band resonance characteristics.

26. The antenna system of claim 25 wherein the first and the second monopole elements each comprise a quadrilaterally-shaped conductive region.

27. The antenna system of claim 25 wherein the first and the second monopole elements each comprise a polygonally-shaped conductive region.

28. The antenna system of claim 21 further comprising first and second signal transmission lines on the first surface each connected to one of the first and the second monopole elements.

29. The antenna system of claim 28 wherein the first and the second signal transmission lines are disposed proximate the first ground plane.

30. The antenna system of claim 21 wherein the first and the second monopole elements each comprise a conductive region bounded by a plurality of linear and curved segments.

31. The antenna system of claim 21 wherein the first ground plane is disposed on the first surface and further comprises an edge proximate the first and the second monopole elements, and wherein the first and the second monopole elements are spaced apart from the edge to control a distributed capacitance formed between the first and the second monopole elements and the first ground plane.

32. The antenna system of claim 21 wherein a material of the dielectric substrate is flexible.

33. The antenna system of claim 21 wherein a radiation pattern of the first and the second monopole elements is omnidirectional.

34. The antenna system of claim 21 wherein a signal polarization of the first and the second monopole elements is linear.

35. The antenna system of claim 21 further comprising first and second transmission lines each connected to the first and the second monopole elements at an edge of each of the first and the second monopole elements, respectively, wherein the edge is shaped to provide an impedance match between the first and the second transmission lines and the respective one of the first and the second monopole elements.

36. The antenna system of claim 21 wherein each one of the first and the second monopole elements further comprises a distal edge spaced in a direction away from the ground plane, and wherein the distal edge of each of the first and the second monopole elements is shaped to provide an impedance match between the respective first and second monopole elements and air.

37. The antenna system of claim 21 wherein the first ground plane is disposed on the first surface, the antenna system further comprising first and second transmission lines disposed on the first surface and connected respectively to the first and the second monopole elements, wherein each of the first and the second transmission lines is disposed proximate the first ground plane, and wherein the first ground plane comprises an edge proximate the first and the second monopole elements, and wherein the first and the second transmission lines extend beyond the edge, and wherein an angle formed between the edge and the first and the second transmission lines is selected to achieve a desired antenna radiation pattern.

38. The antenna system of claim 37 wherein the angle is about 90°.

39. The antenna system of claim 37 wherein a shape of the edge is symmetric in a region where the first and the second transmission lines extend beyond the edge.

40. The antenna system of claim 21 wherein the first ground plane is disposed on the first surface and further comprises an edge proximate the first and the second monopole elements, and wherein a shape of the edge is selected to provide desired antenna operational parameters.

41. The antenna system of claim 21 wherein each one of the first and the second monopole elements comprises a conductive region have a polygonal shape for providing a plurality of resonant frequencies.

42. The antenna system of claim 21 wherein the first and the second monopole elements are spaced apart to provide spatial diversity.

43. The antenna system of claim 21 wherein the first and the second monopole elements are oriented to provide signal polarization diversity.

44. The antenna system of claim 21 wherein an operative one of the first and the second monopole elements is selected in response to a measured signal metric.

45. The antenna system of claim 21 wherein the first ground plane is disposed on the first surface.

46. The antenna system of claim 21 operative in a first mode wherein one of the first and the second monopole elements is operative in response to a measured signal metric or operative in a second mode wherein both the first and the second monopole elements are operative, and wherein in both the first and the second modes the first and the second monopole elements operate in conjunction with the first signal feed and the second signal feed, respectively.

47. A wireless communications device for receiving and transmitting radio frequency signals, comprising:

a dielectric substrate;

electronic components mounted on the dielectric substrate;

first and second spaced-apart monopole elements disposed on the dielectric substrate;

a ground plane proximate the first and the second monopole elements;

a measuring component for determining a signal quality metric for each of the first and the second monopole elements; and a selecting component responsive to the measuring component for selecting the first or the second monopole element for receiving or transmitting the radio frequency signal based on a one of the first and the second monopole elements having the better signal quality metric.

48. The wireless communications device of claim 47 wherein the first and the second monopole elements are oriented to provide spatial diversity in receiving and transmitting the radio frequency signals.

49. The wireless communications device of claim 47 wherein the first and the second monopole elements are oriented to provide signal polarization diversity in receiving and transmitting the radio frequency signals.

50. The wireless communications device of claim 47 wherein the electronic components further comprise a compensation network for providing a resonance condition of the first and the second monopole elements.

51. A method for forming an antenna system, comprising:

providing a dielectric substrate having a first surface;

forming first and second spaced-apart conductive regions on the first surface;

forming a first ground plane proximate the first and the second conductive regions; and forming a first signal feed connected to the first monopole element and a second signal feed connected to the second monopole element.

52. The method of claim 51 wherein the first and the second conductive regions comprise monopole elements.

53. The method of claim 51 wherein the step of forming the first and the second conductive regions comprises applying conductive material on the first surface.

54. The method of claim 51 wherein the dielectric substrate comprises conductive material on the first surface, and wherein the step of forming the first and the second conductive regions comprises removing regions of the conductive material such that the remaining conductive material comprises the first and second conductive regions.

55. The method of claim 51 wherein the step of forming the first ground plane comprises forming the first ground plane on the first surface by disposing conductive material on the first surface.

56. The method of claim 51 wherein the dielectric substrate comprises conductive material on the first surface, and wherein the step of forming the first ground plane comprises removing conductive material from the first surface such that the remaining conductive material comprises the first ground plane.

57. The method of claim 51 wherein the dielectric substrate further comprises a second surface parallel to the first surface, and further comprising forming a second ground plane and third and fourth spaced-apart conductive regions on the second surface, wherein a shape of the third and the fourth conductive regions is substantially similar to a shape of the first and the second conductive regions, and wherein the third and the fourth conductive regions are disposed underlying and substantially aligned with the first and the second conductive regions, respectively.

* * * * *